US005569643A

United States Patent [19]

Kinoshita et al.

[11] Patent Number: 5,569,643

[45] Date of Patent: *Oct. 29, 1996

[54] GREASE COMPOSITION FOR CONSTANT VELOCITY JOINT

[75] Inventors: Hirotugu Kinoshita, Kanagawa-ken; Souichi Nomura, Tokyo; Masaru Mishima, Kanagawa-ken, all of Japan

[73] Assignee: Nippon Oil Co., Ltd., Tokyo, Japan

[ * ] Notice: The term of this patent shall not extend beyond the expiration date of Pat. No. 5,462,683.

[21] Appl. No.: 499,942

[22] Filed: Jul. 10, 1995

Related U.S. Application Data

[63] Continuation-in-part of Ser. No. 135,254, Oct. 12, 1993, Pat. No. 5,462,683, which is a continuation-in-part of Ser. No. 115,457, Sep. 1, 1993, abandoned, which is a continuation of Ser. No. 846,357, Mar. 5, 1992, abandoned.

[30] Foreign Application Priority Data

Mar. 7, 1991 [JP] Japan ..... 3-42081

[51] Int. Cl.[6] ..... C10M 125/26; C10M 123/02

[52] U.S. Cl. ..... 508/155

[58] Field of Search ..... 252/18, 25

[56] References Cited

U.S. PATENT DOCUMENTS

| | | | |
|---|---|---|---|
| 2,837,549 | 6/1958 | Reeves et al. | 252/32.7 E |
| 3,017,361 | 1/1962 | Morris et al. | 252/35 |
| 3,196,109 | 7/1965 | Morway et al. | 252/25 |
| 3,345,290 | 10/1967 | Strohmaier | 252/25 |
| 3,423,318 | 1/1969 | Bauer et al. | 252/49.6 |
| 3,607,747 | 9/1971 | Ishikawa | 252/18 |
| 3,669,884 | 6/1972 | Wright | 252/36 |
| 3,801,505 | 4/1974 | Hong . | |
| 3,919,096 | 11/1975 | Olszewski | 252/49 |
| 3,929,650 | 12/1975 | King et al. | 252/33.4 |
| 4,098,705 | 7/1978 | Sakurai | 252/33.6 |
| 4,115,284 | 9/1978 | Kinoshita et al. | 252/25 |
| 4,168,241 | 9/1979 | Kozima | 252/18 |
| 4,436,649 | 3/1984 | Stemke | 252/51.5 A |
| 4,514,312 | 4/1985 | Root . | |
| 4,717,491 | 1/1988 | Cardis | 252/46.7 |
| 4,752,416 | 6/1988 | Scharf | 252/49.8 |
| 4,780,231 | 10/1988 | Kinoshita | 252/51.5 A |
| 4,822,507 | 6/1988 | Kanamori | 252/49.8 |
| 4,877,557 | 10/1989 | Kaneshige | 252/49.8 |
| 4,915,860 | 4/1990 | Kinoshita et al. | 252/51.5 A |
| 5,000,862 | 3/1991 | Waynick | 252/11 |
| 5,043,085 | 8/1991 | Kinoshita et al. | 252/51.5 A |
| 5,145,591 | 9/1992 | Kinoshita et al. | 252/51.5 R |
| 5,160,645 | 11/1992 | Okaniwa | 252/33.6 |
| 5,207,936 | 5/1993 | Anzai | 252/33.6 |
| 5,403,501 | 4/1995 | Schwind | 252/32.7 E |
| 5,462,683 | 10/1995 | Kinoshita et al. | 252/25 |

FOREIGN PATENT DOCUMENTS

| | | |
|---|---|---|
| 233757 | 8/1987 | European Pat. Off. . |
| 296362 | 12/1987 | European Pat. Off. . |
| 386653 | 9/1990 | European Pat. Off. . |
| 0414191A1 | 2/1991 | European Pat. Off. . |
| 453565 | 10/1991 | European Pat. Off. . |
| 0508115A1 | 10/1992 | European Pat. Off. . |
| 55-092800 | 7/1980 | Japan . |
| 1259097 | 10/1989 | Japan . |
| 2185492 | 7/1987 | United Kingdom . |

OTHER PUBLICATIONS

Smalheer et al, *Lubricant Additives*, pp. 1–11, 1967 no month.

*Primary Examiner*—Jerry D. Johnson
*Attorney, Agent, or Firm*—Darby & Darby, P.C.

[57] ABSTRACT

A grease composition for a constant velocity joint contains a base oil containing 2 to 25 wt. % of a thickener based on total weight of the composition, 0.5 to 20 wt. % of boron nitride powders based on total weight of the composition, and 0.1 to 10 wt. % of an extreme pressure agent based on total weight of the composition selected from the group consisting of molybdenum dithiocarbamate, a sulfur and phosphorus-containing extreme pressure agent, and mixtures thereof. The boron nitride powders have mean particle size of more than 5 μm and not more tha 20 μm.

11 Claims, No Drawings

GREASE COMPOSITION FOR CONSTANT VELOCITY JOINT

CROSSE-REFERENCE TO RELATED APPLICATION

This application is a continuation-in-part application of Ser. No. 08/135,254 filed Oct. 12, 1993, now U.S. Pat. No. 5,462,683 which is in turn a continuation-in-part application of Ser. No. 08/115,457 filed Sep. 1, 1993, now abandoned which is in turn a continuation application of Ser. No. 07/846,357 filed Mar. 5, 1992, abandoned.

BACKGROUND OF THE INVENTION

The present invention relates to a grease composition for a constant velocity joint or a fixed type joint and slide type joint.

In general, a combination of a fixed type joint, a shaft and a thrust type joint is employed when a constant velocity joint is applied in FF type or front wheel driven type cars.

Examples of fixed type joints include Birfield joints, Rzeppa joints, undercutting free joints and tripod joints. Examples of slide type joints include double off-set joints, tripod joints and closs groove joints.

Constant velocity joints are generally lubricated with an extreme pressure grease made up of a base grease consisting of a purified mineral oil, a lithium soap and an urea thickner which is combined with molybdenum disulfide, a sulfur-phosphorus compound, a lead compound, etc.

In the grease composition for the constant velocity joint, there are required characteristics such as anti-flaking, anti-seizure, abrasion resistance or low friction properties. However, there are tendencies to high performance and high quality of an automobile so that the conventional grease compositions are generally lacking in these areas. In particular, in the view of a prolonged life time of the constant velocity joint, it has been desired to improve the anti-flaking performance. Flaking means structural destruction occurring within the interior of metal, which is totally different from seizure occurring on metal surfaces. With the conventional extreme pressure agents, flaking has not been fully avoided.

SUMMARY OF THE INVENTION

It is an object of the present invention to provide a grease composition for a constant velocity joint which is superior in anti-flaking performance prolonging the life time of the constant velocity joint.

The above and other objects of the present invention will become apparent from the following description.

According to the present invention, there is provided a grease composition for a constant velocity joint comprising a base oil containing (A) 2 to 25 wt. % of a thickener based on total weight of the composition, (B) 0.5 to 20 wt. % of boron nitride powders based on total weight of the composition, the boron nitride powders having mean particle size of more than 5 μm and not more than 20 μm, and (C) 0.1 to 10 wt. % of an extreme pressure agent based on total weight of the composition selected from the group consisting of molybdenum dithiocarbamate, a sulfur and phosphorus-containing extreme pressure agent, and mixtures thereof.

PREFERRED EMBODIMENTS OF THE INVENTION

The present invention will be explained in more detail hereinbelow.

Any base oils, any oils such as a petroleum lube base oil and a synthetic lube base oil commonly used as the lube base oil may be employed as the base oil, of the present invention. Petroleum lube base oil may be preferably employed. Examples of the petroleum lube base oils include base oils such as paraffin lube base oil, naphthene lube base oil and the like obtained by subjecting lubricant fractions obtained by distillation under atmospheric or reduced pressure to refining treatment such as solvent deasphalting, solvent extraction, hydrocracking, solvent dewaxing, contact dewaxing, hydrofining, washing with sulfuric acid, clay treatment and the like.

Examples of synthetic lube base oils include poly-α-olefin such as polybutene, 1-octen oligomers and 1-decene oligomers; alkylbenzene; alkylnaphthalene; diester such as ditridecyl glutarate, di-2-ethylhexyl adipate, diisodecyl adipate, ditridecyl adipate and di-3-ethylhexyl sebacate; polyol ester such as trimethylolpropane caprylate, trimethylolpropane pelargonate, pentaerythritol-2-ethyl hexanoate and pentaerythritol pelargonate; polyoxyalkylene glycol; polyphenyl ether; silicone oil or perfluoroalkyl ether may be employed. Two or more of the above mentioned oils may also be employed as a mixture. Any viscosity ranges commonly used may be employed. More preferably, it may be 2 to 40 cSt at 100° C. The content of the base oil may be preferably 50 to 97.5 wt. % based on the total weight of the composition.

Any thickener may be employed in the base oil as component (A). For example, a soap thickener such as a metal soap and a complex metal soap; a non-soap thickener such as bentone, silica gel, urea compounds, urea-urethane compounds and urethane compounds may be employed. More preferably, urea compounds, urea-urethane compounds, urethane compounds and mixtures thereof which are superior in heat resistance may be employed.

Examples of the metal soap and the complex matal soap, for example, a sodium soap, a calcium soap, an aluminum soap, a lithium soap and the like may be employed. Lithium soap has good compatibility with the base oil. Examples of urea compounds, the urea-urethane compounds and the urethane compounds include diurea compounds, triurea compounds, tetraurea compounds, polyurea compounds other than the aforementioned urea compounds, urea-urethane compounds, diurethane compounds and mixtures thereof. It is preferable that diurea compounds, urea-urethane compounds, diurethane compounds and mixtures thereof be employed. More preferably, there may be employed a compound or mixtures obtained by mixing two or more compounds represented by the formula ( 1 ):

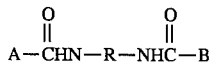

$$A-\overset{\overset{\displaystyle O}{\|}}{C}HN-R-NH\overset{\overset{\displaystyle O}{\|}}{C}-B \qquad (1)$$

wherein R stands for a divalent hydrocarbon group, and A and B may be the same or different and each stand for $R^1$—NH—,

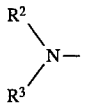

or $R^4$—O—, wherein $R_1$, $R^2$, $R^3$ and $R^4$ may be the same or different and each stand for a hydrocarbon residue having 6 to 20 carbon atoms.

The aforementioned R in the formula (1) may be preferably a divalent hydrocarbon group having 6 to 20 carbon atoms, more preferably 6 to 15 carbon atoms. As the divalent hydrocarbon group, there may preferably be employed a straight chain or branched alkylene group or alkenylene group, a cycloalkylene group or an aromatic group. For example, it may include —($CH_2$)— and groups represented by the following formulas and the like:

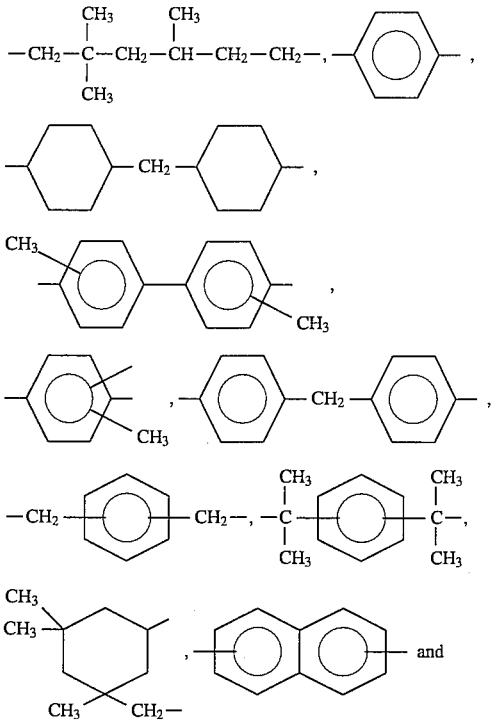

-continued

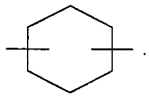

As the aforementioned $R^1$, $R^2$, $R^3$ and $R^4$ there may be preferably employed a straight chain or branched alkyl group or alkenyl group, a cycloalkyl group and an aromatic group. For example, it may include hexyl group, heptyl group, octyl group, nonyl group, decyl group, undecyl group, dodecyl group, tridecyl group, tetradecyl group, pentadecyl group, hexadecyl group, heptadecyl group, octadecyl group, nonadecyl group, eicocyl group, hexenyl group, heptenyl group, octenyl group, nonenyl group, decenyl group, undecenyl group, dodecenyl group, tridecenyl group, tetradecenyl group, pentadecenyl group, hexadecenyl group, heptadecenyl group, octadecenyl group, nonadecenyl group, eicocenyl group, cyclohexyl group, methylcyclohexyl group, dimethylcyclohexyl group, etheylcyclohexyl group, diethylcyclohexyl group, propylcyclohexyl group, isopropylcyclohexyl group, 1-methyl-3-propylcyclohexyl group, butylcyclohexyl group, amylcyclohexyl group, amylmethylcyclohexyl group, hexylcyclohexyl group, heptylcyclohexyl group, octylcyclohexyl group, nonylcyclohexyl group, decylcyclohexyl group, undecylcyclohexyl group, dodecylcyclohexyl group, tridecylcyclohexyl group, tetradecylcyclohexyl group, phenyl group, toluyl group, benzyl group, ethylphenyl group, methylbenzyl group, xylyl group, propylphenyl group, cumenyl group, etheylbenzyl group, naphthyl group, methylnaphthyl group, ethylnaphthyl group, dimethylnaphthyl group and propylnaphthyl group.

The compound represented the formula (1) may include the following compounds:

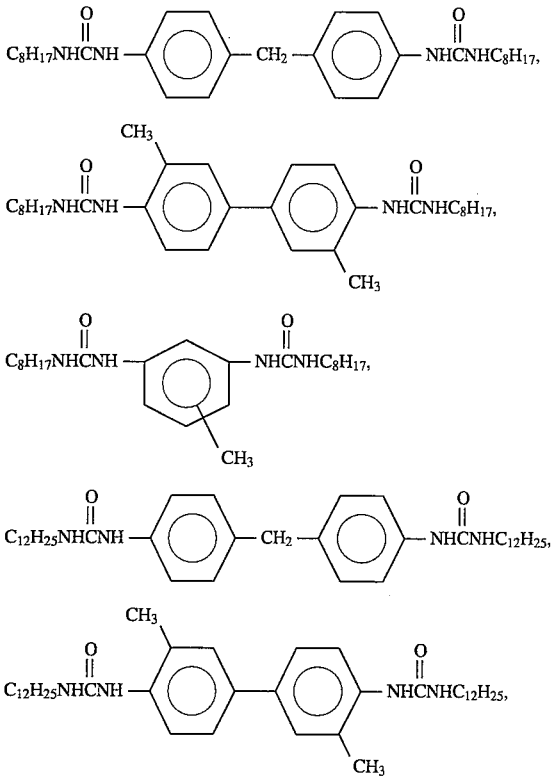

-continued
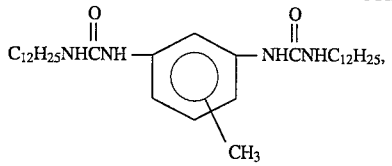
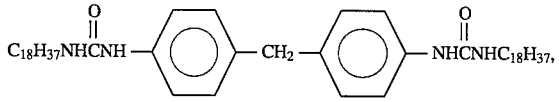
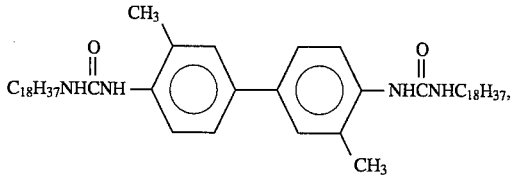
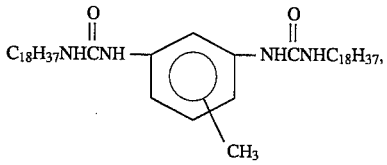
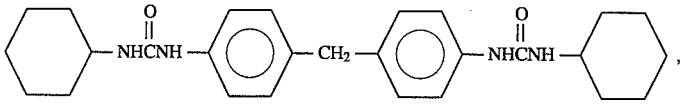
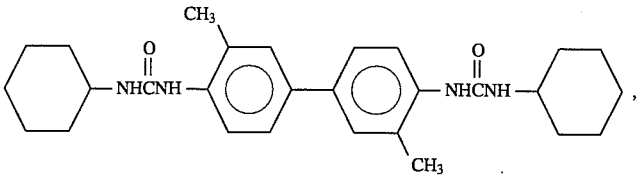
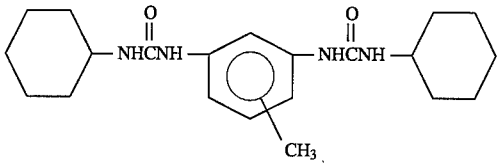
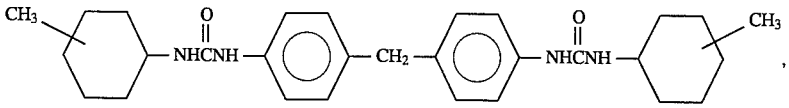
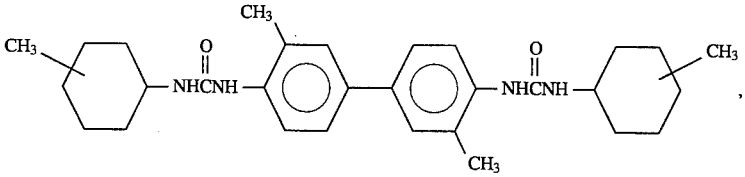
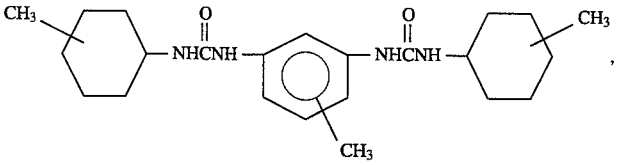
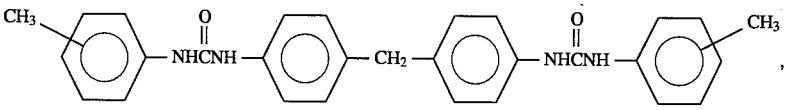

-continued
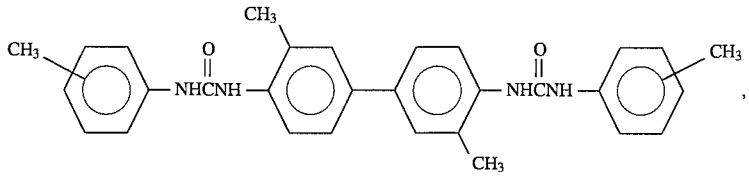
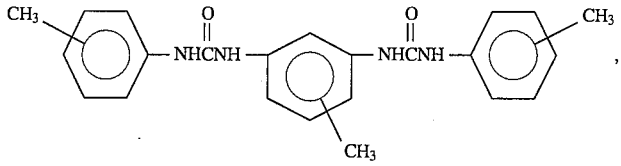
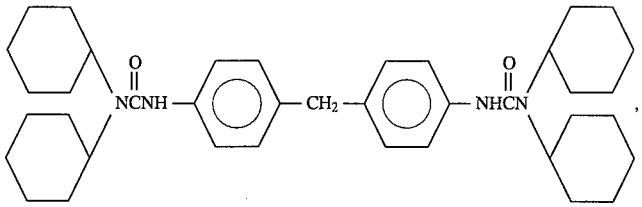
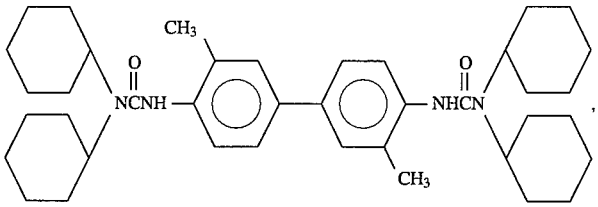
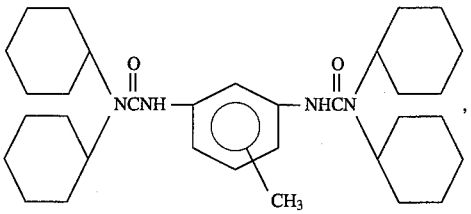
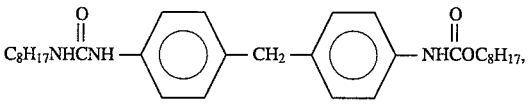
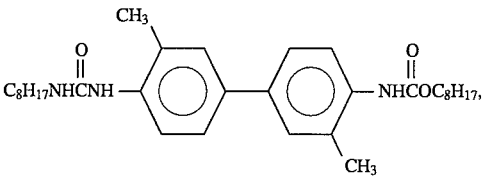
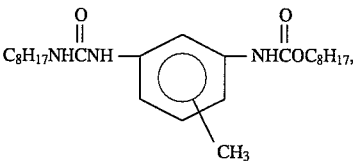
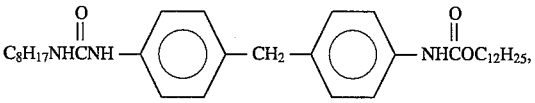

-continued
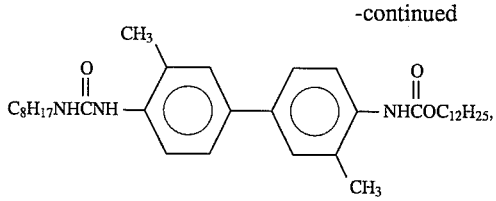
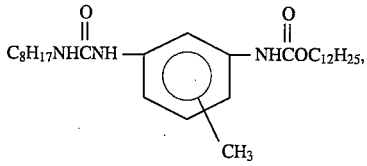
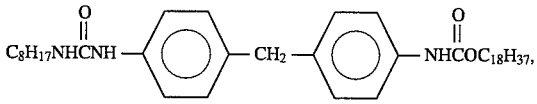
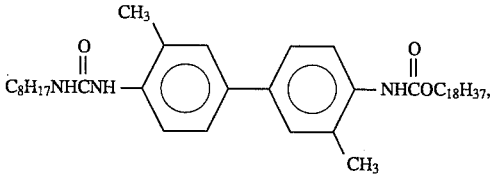
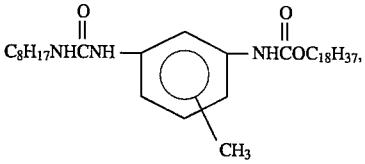
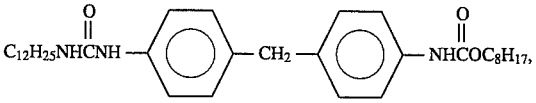
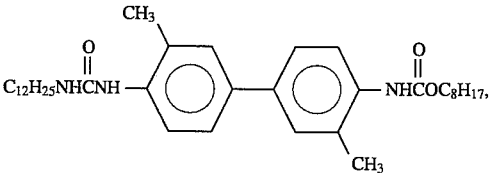
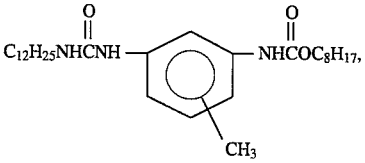
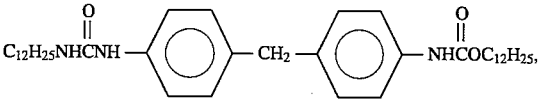
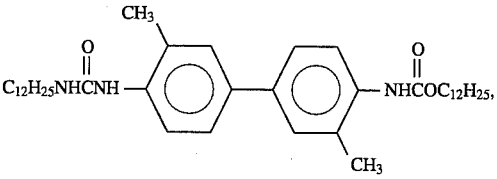

-continued
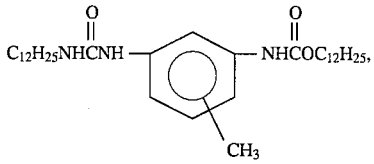
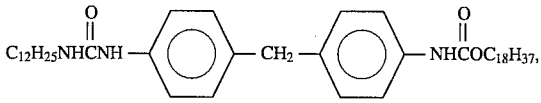
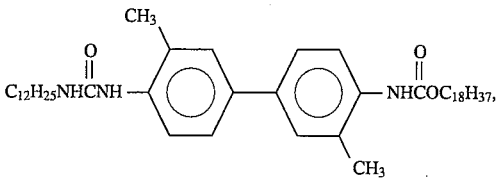
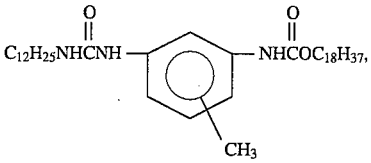
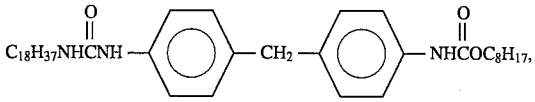
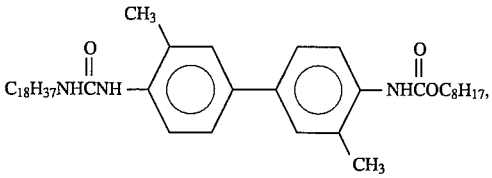
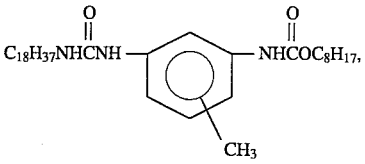
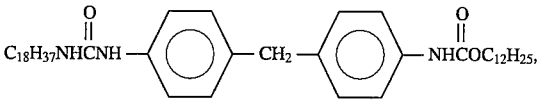
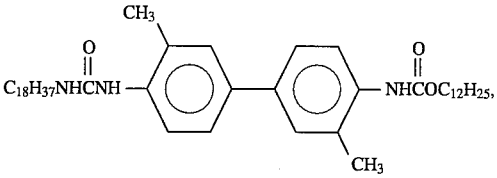
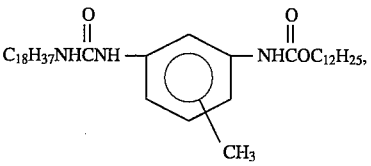
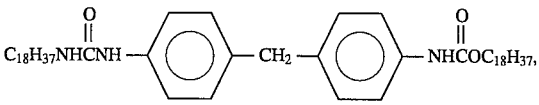

-continued
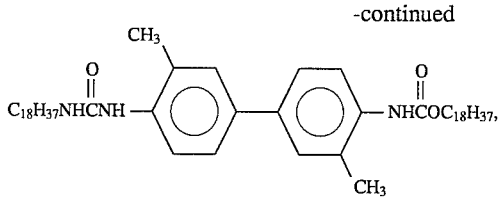
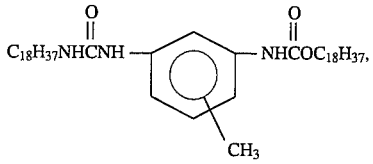
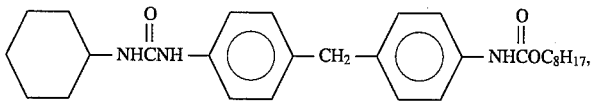
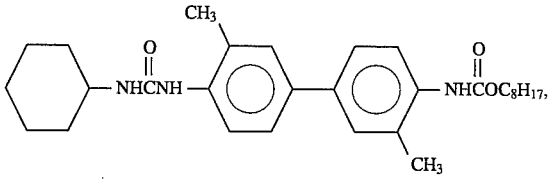
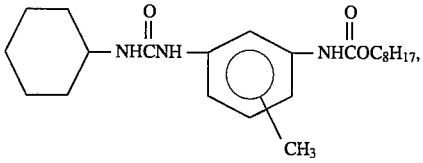
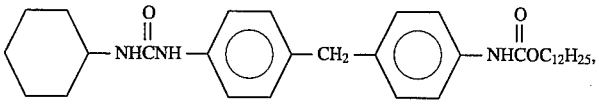
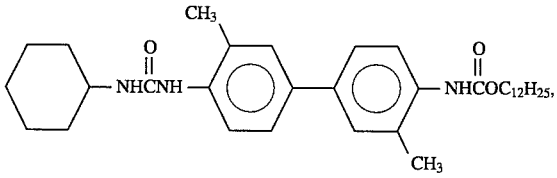
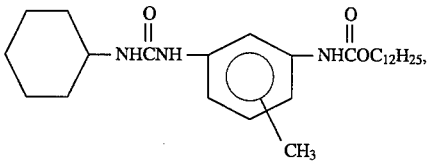
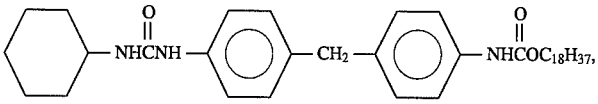
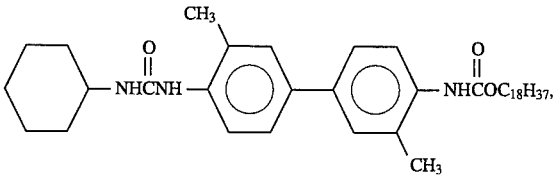

-continued
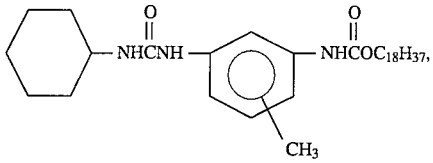
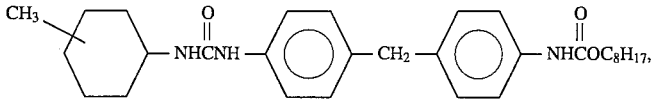
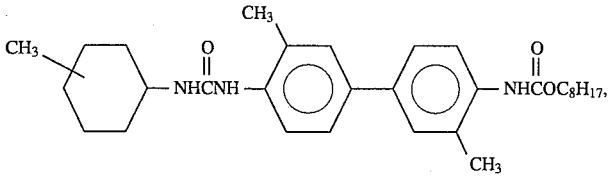
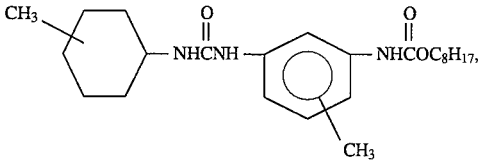
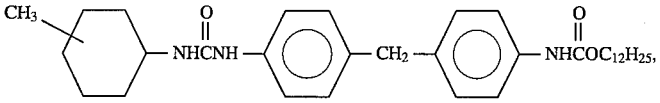
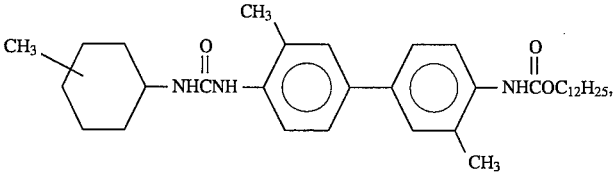
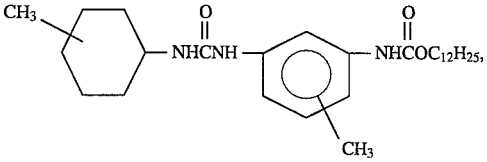
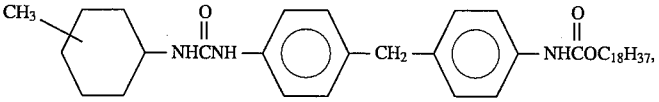
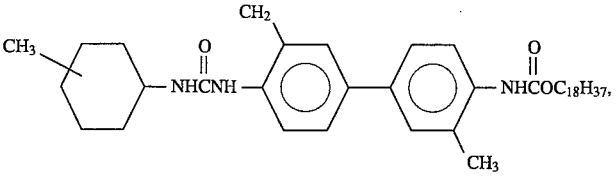
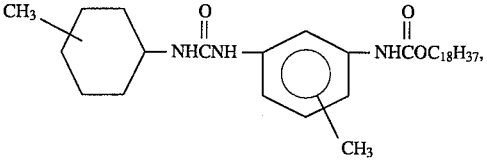
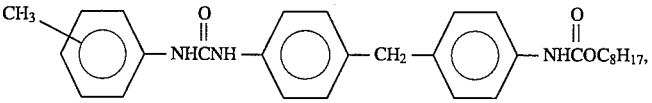

-continued
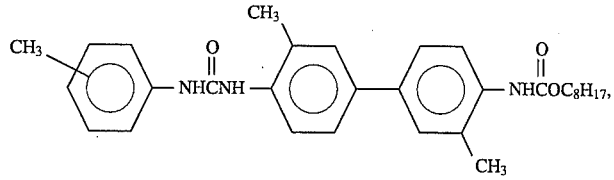
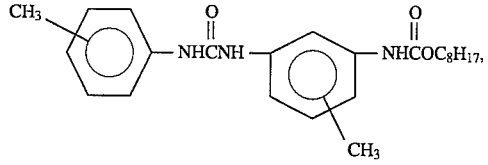
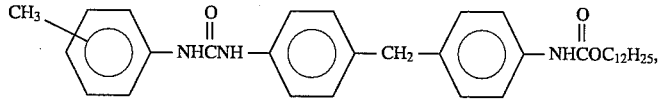
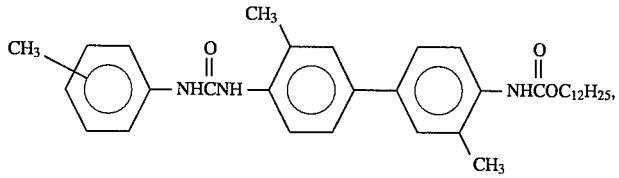
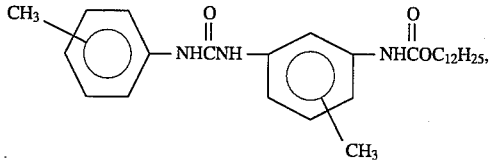
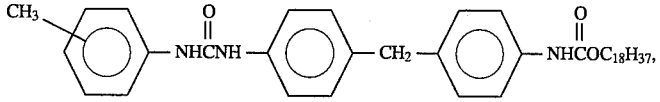
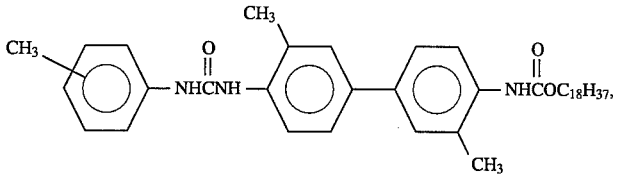
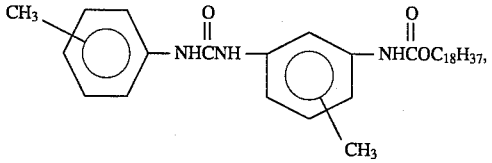

-continued
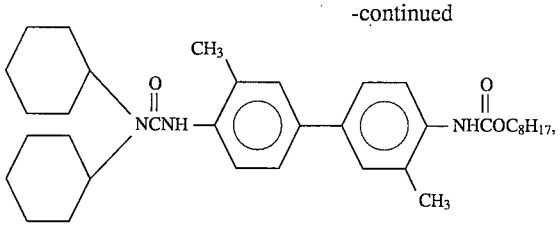
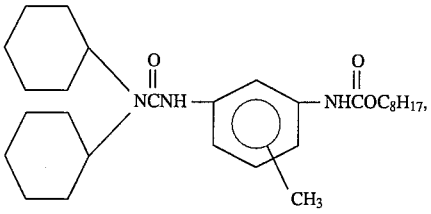
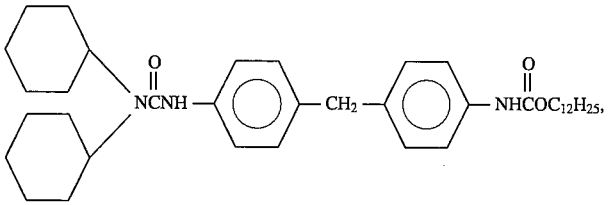
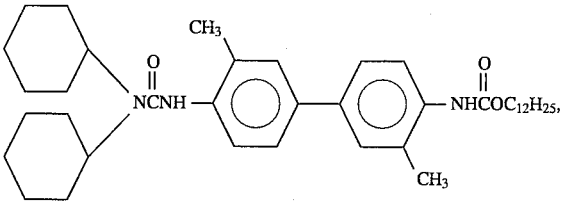
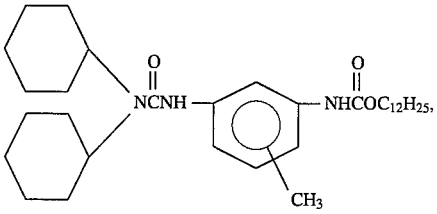
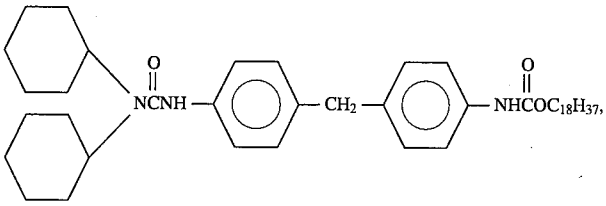
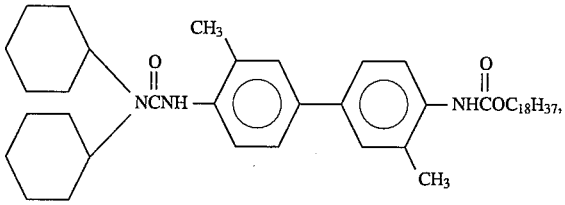

-continued
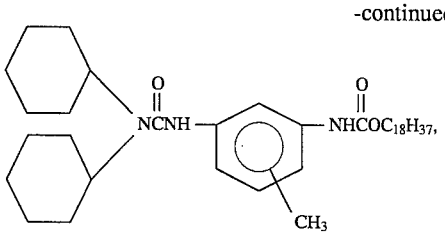
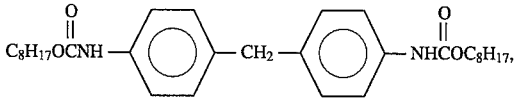
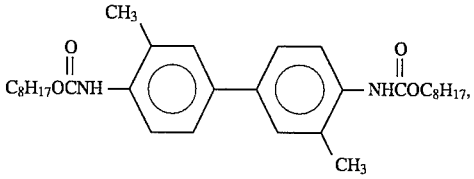
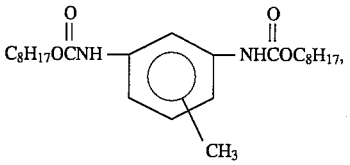
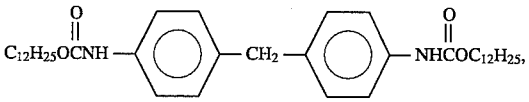
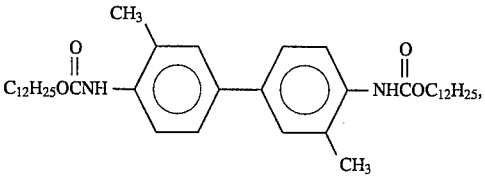
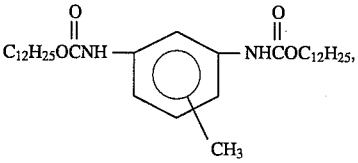
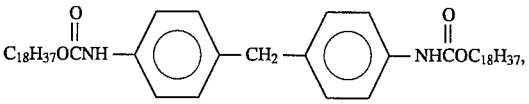
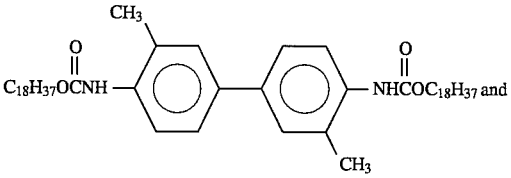
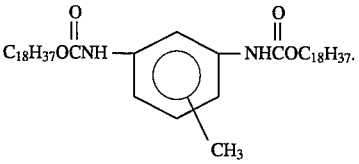

More in detail, for example, the compounds may be employed which are described in Japanese Patent Publication No. 55-11156, Japanese Laid-open Patent Application No. 62-250097 and Japanese Laid-open Patent Application No. 64-9296.

To prepare the diurea compound, the urea-urethane compound or the diurethane compound, for example, diisocyaneate represented by OCN—R—NCO may be reacted with a compound represented by $R^1$—$NH_2$,

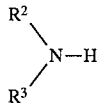

or $R^4$—OH or mixtures thereof in the base oil at the temperature of 10 to 200° C. R, $R^1$, $R^2$, $R^3$ and $R^4$ may be the same as those of the formula (1).

The content of the thickener should be 2 to 25 wt. %, more preferably 3 to 20 wt. % based on the total weight of the composition. When the content is less than 2 wt. %, the amount of the thickener is so small that sufficiently greasy state is not obtained. When the content is above 25 wt. %, the grease is so hard that the satisfactory lubrication is not obtained.

A mean particle size of the boron nitride powder contained in the base oil as component (B) is more than 5μm, and not more than 20 μm. The lower limit may preferably be more than 5.5 μm, more preferably more than 6 μm. The upper limit may preferably be not more than 15 μm, and more preferably not more than 10 μm. If the mean particle size of the boron nitride powder is 5 μm or smaller, anti-flaking performance of the grease composition for a constant velocity joint cannot be satisfactorily achieved. On the other hand, if the mean particle size of the boron nitride powder exceeds 20 μm, the lifetime of the constant velocity joint cannot be fully extended.

The content of the boron nitride powders should be in the range of 0.5 to 20 wt. %, preferably 0.5 to 5 wt. % based on the total weight of the composition. When the content is less than 0.5 wt. %, the anti flaking performance becomes less, and when the coiltent is above 20 wt. %, abrasive wear is accelerated.

The grease composition for a constant velocity joint according to the present invention contains a specific extreme pressure agent as a component (C) in addition to the components (A) and (B). The specific extreme pressure agent includes molybdenum dithiocarbamate, a sulfur and phosphorus-containing extreme pressure agent, and mixtures thereof. When the mixtures of molybdenum dithiocarbamate and the sulfur and phosphorus-containing extreme pressure agent are used, the lifetime of the constant velocity joint can be prolonged at most.

The molybdenum dithiocarbamate may be represented by the formula:

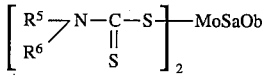

In the above formula, $R^5$ and $R^6$ may be the same or different and denote a C1 to C24 alkyl, cycloalkyl, aryl, alkylaryl or arylalkyl group, while a denotes a number such that $0 \leqq a \leqq 4$ and b a number such that $0 \leqq b \leqq 4$ and $0 \leqq a+b \leqq 4$, respectively.

Examples of $R^5$ and $R^6$ may include methyl, ethyl, propyl, butyl, pentyl, hexyl, heptyl, octyl, nonyl, decyl, dodecyl, tetradecyl, hexadecyl, octadecyl, eicosyl, docosyl, tetracosyl, cyclopentyl, cyclohexyl, methylcyclohexyl, ethylcyclohexyl, dimethyl cyclohexyl, cycloheptyl, phenyl, tolyl, xylyl, ethylphenyl, propylphenyl, butylphenyl, pentylphenyl, hexylphenyl, heptylphenyl, octylphenyl, nonylphenyl, decylphenyl, dodecylphenyl, tetradecylphenyl, hexadecylphenyl, octadecylphenyl, benzyl and phenetyl groups.

Examples of molbdenum dithiocarbamate preferably include molybdenum sulfide diethyldithiocarbamate, molybdenum sulfide dipropyldithiocarbamate, molybdenum sulfide dibutyldithiocarbamate, molybdenum sulfide dipentyldithiocarbamate, molybdenum sulfide dihexyldithiocarbamate, molybdenum sulfide dioctyldithiocarbamate, molybdenum sulfide didecyldithiocarbamate, molybdenum sulfide didodecyldithiocarbamate, molybdenum sulfide di(butylphenyl)dithiocarbamate, molybdenum sulfide di(nonylphenyl)dithiocarbamate, molybdenum oxysulfide diethyldithiocarbamate, molybdenum oxysulfide dipropyldithiocarbamate, molybdenum oxysulfide dibutyldithiocarbamate, molybdenum oxysulfide dipentyldithiocarbamate, molybdenum oxysulfide dihexyldithiocarbamate, molybdenum oxysulfide dioctyldithiocarbamate, molybdenum oxysulfide didecyldithiocarbamate, molybdenum oxysulfide didodecyldithiocarbamate, molybdenum oxysulfide di(butylphenyl)dithiocarbamate, molybdenum oxysulfide di(nonylphenyl)dithiocarbamate, and mixtures thereof.

The sulfur and phosphorus-containing extreme pressure agent employed according to the present invention is an extreme pressure agent containing sulfur and phosphorus atoms. Accordingly, when a sulfur-containing compound and a phosphorus-containing compound are used as the extreme pressure agent, the both compounds must be employed in combination. On the other hand, when an extreme pressure agent containing both sulfur and phosphorus atoms in its molecule is employed, such extreme pressure agent may be used alone. The sulfur-containing compound includes a sulfide of fats and oils, a polysulfide, and mixtures thereof. The sulfides of fats and oils herein mean compounds obtained by adding sulfur to animal or vegetable fats and oils having unsaturated bonds, such as olive oil, castor oil, tea seed oil, rice bran oil, cotton seed oil, rape seed oil, corn oil, beef tallow, nest's foot oil, sperm oil or spermaceti, and heating the resulting mixture.

The polysulfides mean polysulfides represented by the formula:

$$R^7—S_c—R^8$$

or olefin sulfides containing 2 to 5 bound sulphur atoms in each molecule. In the above formula, $R^7$ and $R^8$ may be the same or different and denote a C4 to C22 alkyl, aryl, alkylaryl or arylalkyl group, and C denotes an integer from to 5. Examples of the polysulfides include dibutyl polysulfide, dihexyl polysulfide, dioctyl polysulfide, dinonyl polysulfide, didecyl polysulfide, didodecyl polysulfide, ditetradecyl polysulfide, dihexadecyl polysulfide, dioctadecyl polysulfide, dieicosyl polysulfide, diphenyl polysulfide, dibenzyl polysulfide, diphenetyl polysulfide, polybutenyl polysulfide and mixtures thereof.

The phosphorus-containing compound contains a phosphate, a phosphite, and mixtures thereof.

By the phosphates are meant compounds represented by the formula:

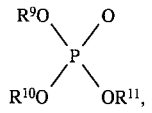

and, by the phosphites are meant compounds represented by the formula:

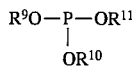

In the above formulae, $R^9$ stands for a C1 to C24 alkyl, cycloalkyl, alkylcycloalkyl, aryl, alkylaryl or arylalkyl group, and $R^{10}$ and $R^{11}$ stand for a hydrogen atom or a C1 to C24 alkyl, cycloalkyl, alkylcycloalkyl, aryl, alkylaryl or arylalkyl group.

Examples of $R^9$ may include methyl, ethyl, propyl, butyl, pentyl, hexyl, heptyl octyl, nonyl, decyl, dodecyl, tetradecyl, hexadecyl, octadecyl, eicosyl, docosyl, tetracosyl, cyclopentyl, cyclohexyl, methylcyclohexyl, ethylcyclohexyl, dimethylcyclohexyl, cycloheptyl, phenyl, tolyl, xylyl, ethylphenyl, propylphenyl, butylphenyl, pentylphenyl, hexylphenyl, heptylphenyl, octylphenyl, nonylphenyl, decylphenyl, dodecylphenyl, tetradecylphenyl, hexadecylphenyl, octadecylphenyl, benzyl and phenetyl groups. Examples of $R^{10}$ and $R^{11}$ may include hydrogen atoms or alkyl, cycloalkyl, alkylcycloalkyl, aryl, alkylaryl and arylalkyl groups.

Examples of the extreme pressure agent containing both sulfur and phosphorus atoms in its molecule may include a thiophosphate, a thiophosphite, and mixtures thereof. The thiophosphate may be represented by the aforementioned formula of the phosphate wherein at least one of the oxygen atoms is substituted with a sulfur atom. The thiophosphite may be represented by the aforementioned formula of the phosphite wherein at least one of the oxygen atoms is substituted with a sulfur atom. A combined use of the polysulfide with the phosphate or of the sulfide of fats and oils with the phosphate is preferred. The ratio by weight of the sulfur-containing compound to the phosphorus-containing compound may be 100:25 to 100:1 in terms of sulfur and phosphorus atoms.

In the grease composition of the present invention, the content of the component (C) is 0.1 to 10 wt. % and preferably 1.0 to 5.0 wt. % based on the total weight of the composition. The content of tile component (C) short of the above range is not desirable since then wear-resistance and anti-scuffing properties are insufficient. On the other hand, the content of the component (C) in excess of the above range also is not desirable since not only the effects proportionate to the amount of addition cannot be obtained but also the amount of wear is increased.

When the molybdenum dithiocarbamate and the sulfur and phosphorus-containing extreme pressure agent are employed in combination, a weight ratio of the former to the latter may preferably be 1:5 to 5:1, and more preferably 1:3 to 3:1.

To the grease composition for a constant velocity joint according to the present invention, there may be further added solid lubricants, other extreme pressure agents, anti-oxidants, oilness agents, rust-inhibitors, viscosity index improvers and mixtures thereof to improve the performance of the composition so far as its properties are not damaged.

The solid lubricant, for example may include carbon black, fluorinated carbon black, polytetrafluoroethylene, molybdenum disulfide, antimony sulfide and alkali or alkaline earth metal borate.

The other extreme pressure agent, for example may include a sulfur compound such as monosulfide, sulfoxide and sulfinate; a phosphorus compound such as phosphinate, phosphonate and amine salts thereof; a chlorine compound such as chlorinated paraffin and chlorinated ester and molybdenum compound such as molybdenum dithiophosphate.

The anti-oxidant, for example may include a phenol compound such as 2,6-di-t-buthyl phenol, and 2,6-di-t-buthyl-p-cresol; an amine compound such as dialkyldiphenyl amine, phenyl-α-naphthyl amine and p-alkylphenyl-α-naphthyl amine; a sulfur compound; and a phenothiazine compound.

The oilness agent, for example may include an amine such as lauryl amine, myristyl amine, palmityl amine, stearyl amine and oleyl amine; a higher alcohol such as lauryl alcohol, myristyl alcohol, palmityl alcohol, stearyl alcohol and oleyl alcohol; a higher fatty acid such as lauric acid, myristic acid, palmitic acid, stearic acid and oleylic acid; a fatty acid ester such as methyl laurate, methyl myristate, methyl palmitate, methyl stearate and methyl oleate; an amido such as lauryl amido, myristyl amido, palmityl amido, stearyl amido and oleyl amido; and fats and oils.

The rust-inhibitor, for example may include a synthetic sulfonate such as metal soap, petroleum sulfonate, alkylbenzene sulfonate and dinonylnaphthalene sulfonate; a partial ester of polyalcohol such as sorbitan fatty acid ester; amine; phosphoric acid; and phosphate.

The viscosity index improver, for example may include polymethacrylate, polyisobuthylene and polystyrene.

To prepare the grease composition for a constant velocity joint of the present invention, the thickener and the boron nitride powders and optionally the organozinc compound and the other additives may be added to the base oil and the mixture may be stirred and then the resulting mixture may be passed through a roll mill and the like to obtain the grease composition. Further, feed components of the thickener may be preliminarily added dissolved and stirred so that the thickener may be prepared to similarly obtain the grease composition.

The grease composition for a constant velocity joint according to the present invention contains at least both the thickener and the boron nitride powders therein so that it is superior in the anti-flaking performance and may prolong the life time of the constant velocity joint.

EXAMPLES OF THE INVENTION

The present invention will be explained in more detail with reference to Examples and Comparative Examples.

Incidentally, the following life time evaluating test was conducted on each produced grease. (Test for Evaluation of the Life Time)

On-Bench Durability Test

Using a commercially available Birfield type joint with size #95, the life time of the joint was evaluated at rotating speed of 300 to 1900 rpm at torque of 20 to 270 N.m and at operating angle of 5° to 14°.

Example 1

46.6 g of diphenylmethane-4,4'-diisocyanate was charged into 425 g of mineral oil and heated to 60° C. so as to be dissolved uniformly therein. To this solution was added a dissolved mixture obtained by heating and dissolving 13.9 g of dodecyl alcohol in 210 g of mineral oil and the resulting mixture was agitated vigorously. After then, to the mixture was added a dissolved mixture obtained by dissolving 29.5 g of cyclohexyl amine in 210 g of mineral oil and the mixture was agitated vigorously again so that a gel-like substance was produced. After the agitation was continued at 100° C. for 30 minutes, additives were added to the gel-like substance and the mixture was agitated and passed through a three-roll roll mill so that a grease composition was produced.

The life time evaluation test was carried out on the obtained grease composition. The result is shown in Table 1. The grease composition is shown hereinbelow.

| Composition | |
|---|---|
| Thickener | 9.0 wt. % |
| Mineral oil (40° C.: 126 cSt) | 84.5 wt. % |
| Boron nitride powders (mean particle size: 7.0 μm) | 1.5 wt. % |
| Molybdenum alkyldithiocarbamate | 1.0 wt. % |
| Sulfide of fats and oils | 2.0 wt. % |
| Tributyl phosphite | 1.0 wt. % |
| Amine anti-oxidant (60 worked consistency: 325) | 1.0 wt. % |

The formula of the thickner used is shown below:

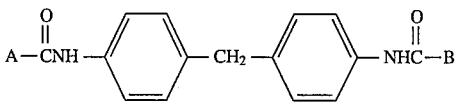

wherein A and B stand for

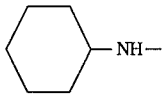

or $C_{12}H_{25}O$— and a molar ratio of

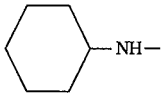

to $C_{12}H_{25}O$— is 80/20.

Example 2

A grease composition was prepared in the same way as in Example 1 except that molybdenum alkyldithiocarbamate was not added. The life time evaluation test was carried out on the grease composition thus obtained. The result is shown in Table 1. The grease composition is shown hereinbelow.

| Composition | |
|---|---|
| Thickener (the same as used in Example 1) | 9.0 wt. % |
| Mineral oil (40° C.: 126 cSt) | 85.5 wt. % |
| Boron nitride powders (mean particle size: 7.0 μm) | 1.5 wt. % |
| Sulfide of fats and oils | 2.0 wt. % |
| Tributyl phosphite | 1.0 wt. % |
| Amine anti-oxidant (60 worked consistency: 323) | 1.0 wt. % |

Example 3

A grease composition was prepared in the same way as in Example 1 except that sulfide of fats and oils and tributyl phosphite were not added, The life time evaluation test was carried out on the grease composition thus obtained. The result is shown in Table 1. The grease composition is shown hereinbelow,

| Composition | |
|---|---|
| Thickener (the same as used in Example 1) | 9.0 wt. % |
| Mineral oil (40° C.: 126 cSt) | 87.5 wt. % |
| Boron nitride powders (mean particle size: 7.0 μm) | 1.5 wt. % |
| Molybdenum alkyldithiocarbamate | 1.0 wt. % |
| Amine anti-oxidant (60 worked consistency: 315) | 1.0 wt. % |

Comparative Example 1

A grease composition was prepared in the same way as in Example 1 except that boron nitride powders having a mean particle size of 0.8 μm were employed. The life time evaluation test was carried out. The result is shown in Table 1. The grease composition is shown herebelow.

| Composition | |
|---|---|
| Thickener (the same as used in Example 1) | 9.0 wt. % |
| Mineral oil (40° C.: 126 cSt) | 84.5 wt. % |
| Boron nitride powders (mean particle size: 0.8 μm) | 1.5 wt. % |
| Molybdenum alkyldithiocarbamate | 1.0 wt. % |
| Sulfide of fats and oils | 2.0 wt. % |
| Tributyl phosphite | 1.0 wt. % |
| Amine anti-oxidant (60 worked consistency: 324) | 1.0 wt. % |

Comparative Example 2

A grease composition was prepared in the same way as in Example 1 except that boron nitride powders having a mean particle size of 4.0 μm were employed. The life time evaluation test was carried out. The result is shown in Table 1. The grease composition is shown herebelow.

| Composition | |
|---|---|
| Thickener (the same as used in Example 1) | 9.0 wt. % |
| Mineral oil (40° C.: 126 cSt) | 84.5 wt. % |
| Boron nitride powders (mean particle size: 4.0 μm) | 1.5 wt. % |
| Molybdenum alkyldithiocarbamate | 1.0 wt. % |
| Sulfide of fats and oils | 2.0 wt. % |
| Tributyl phosphite | 1.0 wt. % |
| Amine anti-oxidant (60 worked consistency: 320) | 1.0 wt. % |

TABLE 1

| | Average life time (hours) |
|---|---|
| Ex. 1 | 396 |
| Ex. 2 | 365 |
| Ex. 3 | 370 |
| Comp. Ex. 1 | 322 |
| Comp. Ex. 2 | 336 |

Although the present invention has been described with reference to the preferred examples, it should be understood that various modifications and variations can be easily made by those skilled in the art without departing from the spirit of the invention. Accordingly, the foregoing disclosure should be interpreted in a limiting sense. The present invention is limited only by the scope of the following claims.

What is claimed is:

1. A grease composition for a constant velocity joint comprising a base oil containing (A) 2 to 25 wt, % of a thickener based on total weight of the composition, (B) 0.5 to 20 wt. % of boron nitride powders based on total weight of the composition, said boron nitride powders having mean particle size of more than 5 μm and not more than 20 μm, and (C) 0.1 to 10 wt. % of an extreme pressure agent based on total weight of the composition selected from the group consisting of molybdenum dithiocarbamate, a sulfur and phosphorus-containing extreme pressure agent, and mixtures thereof.

2. The grease composition according to claim 1 wherein said thickener is a diurea compound.

3. The grease composition according to claim 1, wherein said thickener is represented by the formula (1):

$$A-\overset{\overset{\displaystyle O}{\|}}{C}NH-R-NH\overset{\overset{\displaystyle O}{\|}}{C}-B$$

wherein R stands for a divalent hydrocarbon group, and A and B may be the same or different and each stand for $R^1$—NH—, $$\begin{matrix} R^2 \\ \diagdown \\ N- \\ \diagup \\ R^3 \end{matrix}$$

or $R^4$—O—, wherein $R^1$, $R^2$,$R^3$ and 4 may be the same or different and each stand for a hydrocarbon residue having 6 to 20 carbon atoms.

4. The grease composition according to claim 3, wherein said R is a divalent hydrocarbon group having 6 to 20 carbon atoms.

5. The grease composition according to claim 4, wherein said R is a divalent hydrocarbon group having 6 to 15 carbon atoms.

6. The grease composition according to claim 1, wherein said boron nitride powders have mean particle size of more than 5 μm and not more than 15 μm.

7. The grease composition according to claim 6, wherein said boron nitride powders have mean particle size of more than 5 μm and not more than 10 μm.

8. The grease composition according to claim 1, wherein said sulfur and phosphorus-containing extreme pressure agent is selected from the group consisting of a mixture of a sulfur-containing compound with a phosphorus-containing compound, and an extreme pressure agent containing both sulfur and phosphorus atoms in its molecule.

9. The grease composition according to claim 8, wherein said sulfur-containing compound is selected from the group consisting of a sulfide of fats and oil, a polysulfide, and mixtures thereof.

10. The grease composition according to claim 8, wherein said phosphorus-containing compound is selected from the group consisting of a phosphate, a phosphite, and mixtures thereof.

11. The grease composition according to claim 8, wherein said extreme pressure agent containing both sulfur and phosphorus atoms in its molecule is selected from the group consisting of a thiophosphate, a thiophosphite, and mixtures thereof.

* * * * *